US008216751B2

(12) United States Patent
Tong

(10) Patent No.: US 8,216,751 B2
(45) Date of Patent: Jul. 10, 2012

(54) CURL-FREE FLEXIBLE IMAGING MEMBER AND METHODS OF MAKING THE SAME

(75) Inventor: Yuhua Tong, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 194 days.

(21) Appl. No.: 12/690,068

(22) Filed: Jan. 19, 2010

(65) Prior Publication Data

US 2011/0177439 A1 Jul. 21, 2011

(51) Int. Cl.
*G03G 5/047* (2006.01)

(52) U.S. Cl. ..... 430/58.65; 430/133

(58) Field of Classification Search ..... 430/58.65, 430/133

See application file for complete search history.

(56) References Cited

U.S. PATENT DOCUMENTS

| | | | |
|---|---|---|---|
| 3,121,006 | A | 2/1964 | Middleton et al. |
| 4,286,033 | A | 8/1981 | Neyhart et al. |
| 4,291,110 | A | 9/1981 | Lee |
| 4,338,387 | A | 7/1982 | Hewitt |
| 4,464,450 | A | 8/1984 | Teuscher |
| 4,587,189 | A | 5/1986 | Hor et al. |
| 4,664,995 | A | 5/1987 | Horgan et al. |
| 4,921,773 | A | 5/1990 | Melnyk et al. |
| 5,069,993 | A | 12/1991 | Robinette et al. |
| 5,215,839 | A | 6/1993 | Yu |
| 5,660,961 | A | 8/1997 | Yu |
| 5,756,245 | A | 5/1998 | Esteghamatian et al. |
| 5,958,638 | A | 9/1999 | Katayama et al. |
| 2007/0105031 | A1 * | 5/2007 | Fukushima et al. ..... 430/58.65 |
| 2007/0172749 | A1 * | 7/2007 | Carmichael et al. ..... 430/58.8 |

* cited by examiner

*Primary Examiner* — Mark F Huff
*Assistant Examiner* — Rachel Zhang
(74) *Attorney, Agent, or Firm* — Pillsbury Winthrop Shaw Pittman LLP

(57) ABSTRACT

The presently disclosed embodiments relate generally to layers that are useful in imaging apparatus members and components, for use in electrophotographic, including digital, apparatuses. Embodiments pertain to an improved flexible electrophotographic imaging member that does not require an anticurl back-coating layer to prevent curling. The charge transport layer of the disclosed embodiments comprises a class of hole transporting plasticizers which act to counteract curling as well as impart good electrical performance to the imaging member.

19 Claims, 1 Drawing Sheet

CURL-FREE FLEXIBLE IMAGING MEMBER AND METHODS OF MAKING THE SAME

BACKGROUND

The presently disclosed embodiments relate generally to layers that are useful in imaging apparatus members and components, for use in electrophotographic, including digital, apparatuses. More particularly, the embodiments pertain to an improved electrophotographic imaging member that does not require an anticurl back-coating layer to prevent curling. The charge transport layer of the disclosed embodiments comprises a class of hole transporting plasticizers which act to counteract curling as well as impart good electrical performance to the imaging member.

In electrophotographic printing, the charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as toner. Toner is held on the image areas by the electrostatic charge on the photoreceptor surface. Thus, a toner image is produced in conformity with a light image of the original being reproduced or printed. The toner image may then be transferred to a substrate or support member (e.g., paper) directly or through the use of an intermediate transfer member, and the image affixed thereto to form a permanent record of the image to be reproduced or printed. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

The described electrophotographic copying process is well known and is commonly used for light lens copying of an original document. Analogous processes also exist in other electrophotographic printing applications such as, for example, digital laser printing or ionographic printing and reproduction where charge is deposited on a charge retentive surface in response to electronically generated or stored images.

Multilayered photoreceptors or imaging members have at least two layers, and may include a substrate, a conductive layer, an optional undercoat layer (sometimes referred to as a "charge blocking layer" or "hole blocking layer"), an optional adhesive layer, a photogenerating layer (sometimes referred to as a "charge generation layer," "charge generating layer," or "charge generator layer"), a charge transport layer, and an optional overcoating layer in either a flexible belt form or a rigid drum configuration. In the multilayer configuration, the active layers of the photoreceptor are the charge generation layer (CGL) and the charge transport layer (CTL). Enhancement of charge transport across these layers provides better photoreceptor performance. Multilayered flexible photoreceptor members may include an anti-curl layer on the backside of the substrate, opposite to the side of the electrically active layers, to render the desired photoreceptor flatness.

Typical imaging member belts, such as flexible photoreceptor belt designs, are made of multiple layers comprising a flexible supporting substrate, a conductive ground plane, a charge blocking layer, an optional adhesive layer, a charge generating layer, a charge transport layer. The charge transport layer is usually the last layer, or the outermost layer, to be coated and is applied by solution coating then followed by drying the wet applied coating at elevated temperatures of about 120° C., and finally cooling it down to ambient room temperature of about 25° C. When a production web stock of several thousand feet of coated multilayered photoreceptor material is obtained after finishing solution application of the charge transport layer coating and through drying/cooling process, upward curling of the multilayered photoreceptor is observed. This upward curling is a consequence of thermal contraction mismatch between the charge transport layer and the substrate support. Since the charge transport layer in a typical electrophotographic imaging member device has a coefficient of thermal contraction approximately 3.7 times greater than that of the flexible substrate support, the charge transport layer does therefore have a larger dimensional shrinkage than that of the substrate support as the imaging member web stock cools down to ambient room temperature. The exhibition of imaging member curling after completion of charge transport layer coating is due to the consequence of the heating/cooling processing step, according to the mechanism: (1) as the web stock carrying the wet applied charge transport layer is dried at elevated temperature, dimensional contraction does occur when the wet charge transport layer coating is losing its solvent during 120° C. elevated temperature drying, but at 120° C. the charge transport layer remains as a viscous flowing liquid after losing its solvent. Since its glass transition temperature (Tg) is at 85° C., the charge transport layer after losing of solvent will flow to re-adjust itself, release internal stress, and maintain its dimension stability; (2) as the charge transport layer now in the viscous liquid state is cooling down further and reaching its glass transition temperature (Tg) at 85° C., the CTL instantaneously solidifies and adheres to the charge generating layer because it has then transformed itself from being a viscous liquid into a solid layer at its Tg; and (3) eventual cooling down the solid charge transport layer of the imaging member web from 85° C. down to 25° C. room ambient will then cause the charge transport layer to contract more than the substrate support since it has about 3.7 times greater thermal coefficient of dimensional contraction than that of the substrate support. This differential in dimensional contraction results in tension strain built-up in the charge transport layer which therefore, at this instant, pulls the imaging member upward to exhibit curling. If unrestrained at this point, the imaging member web stock will spontaneously curl upwardly into a tube. To offset the curling, an anticurl back coating is applied to the backside of the flexible substrate support, opposite to the side having the charge transport layer, and render the imaging member web stock with desired flatness.

Although the application of an anticurl back coating is effective to counter and remove the curl, the resulting imaging member in flat configuration does have tension in the charge transport layer nonetheless, creating an internal build-in strain of about 0.27% in the layer. The magnitude of CTL internal build-in strain is very undesirable, because it is added to the induced bending strain of an imaging member belt as the belt bends and flexes over each belt support roller during dynamic fatigue belt cyclic motion under a normal machine electrophotographic imaging function condition in the field. The summation of the internal strain and the cumulative fatigue bending strain sustained in the charge transport layer has been found to exacerbate the early onset of charge transport layer cracking, preventing the belt to reach its targeted functional imaging life. Moreover, imaging member belt employing an anticurl backing coating has added total belt thickness which increases charge transport layer bending strain and speeds up belt cycling fatigue charge transport layer cracking. The cracks formed in the charge transport layer as a result of dynamic belt fatiguing are found to manifest themselves into copy print-out defects, which adversely affect the image quality on the receiving paper.

Various belt function deficiencies have also been observed in the common anticurl back coating formulations used in a typical conventional imaging member belt, such as the anticurl back coating does not always providing satisfying dynamic imaging member belt performance result under a normal machine functioning condition. For example, exhibition of anticurl back coating wear and its propensity to cause electrostatic charging-up are the frequently seen problems to prematurely cut short the service life of a belt and requires its frequent costly replacement in the field. Anticurl back coating wear under the normal imaging member belt machine operational conditions reduces the anticurl back coating thickness, causing the lost of its ability to fully counteract the curl as reflected in exhibition of gradual imaging member belt curling up in the field. Curling is undesirable during imaging belt function because different segments of the imaging surface of the photoconductive member are located at different distances from charging devices, causing non-uniform charging. In addition, developer applicators and the like, during the electrophotographic imaging process, may all adversely affect the quality of the ultimate developed images. For example, non-uniform charging distances can manifest as variations in high background deposits during development of electrostatic latent images near the edges of paper. Since the anticurl back coating is an outermost exposed backing layer and has high surface contact friction when it slides over the machine subsystems of belt support module, such as rollers, stationary belt guiding components, and backer bars, during dynamic belt cyclic function, these mechanical sliding interactions against the belt support module components not only exacerbate anticurl back coating wear, it also causes the relatively rapid wearing away of the anti-curl produced debris which scatters and deposits on critical machine components such as lenses, corona charging devices and the like, thereby adversely affecting machine performance. Moreover, anticurl back coating abrasion/scratch damage does also produce unbalance forces generation between the charge transport layer and the anticurl back coating to cause micro belt ripples formation during electrophotographic imaging processes, resulting in streak line print defects in output copies to deleteriously impact image printout quality and shorten the imaging member belt functional life.

Thus, while the above mentioned electrophotographic imaging members may be suitable or limited for their intended purposes, further improvement on these imaging members are required. For example, there continues to be the need for improvements in such systems, particularly for an imaging member belt that has sufficiently flatness, reduces friction, has superb wear resistance, provides lubricity to ease belt drive, nil or no wear debris, and eliminates electrostatic charge build-up problem, even in larger printing apparatuses. With many of above mentioned shortcomings and problems associated with electrohotographic imaging members having an anticurl back coating now understood, therefore there is a need to resolve these issues through the development of a methodology for fabricating imaging members that produce improve function and meet future machine imaging member belt life extension need.

Conventional photoreceptors are disclosed in the following patents, a number of which describe the presence of light scattering particles in the undercoat layers: Yu, U.S. Pat. No. 5,660,961; Yu, U.S. Pat. No. 5,215,839; and Katayama et al., U.S. Pat. No. 5,958,638. The term "photoreceptor" or "photoconductor" is generally used interchangeably with the terms "imaging member." The term "electrophotographic" includes "electrostatographic" and "xerographic." The terms "charge transport molecule" are generally used interchangeably with the terms "hole transport molecule" and the terms "charge transport layer" are generally used interchangeably the terms "hole transport layer."

SUMMARY

According to aspects illustrated herein, there is provided an anti-curl back coating-free photoreceptor comprising a substrate, a charge generation layer disposed on the substrate, and a charge transport layer disposed on the charge generation layer, wherein the charge transport layer comprises a liquid plasticizer in a matrix of a hole transport molecule and polycarbonate and further wherein the liquid plasticizer has the following chemical structure:

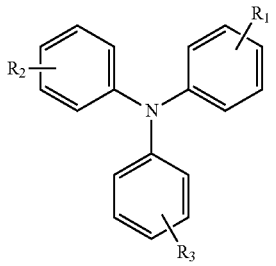

wherein $R_1$, $R_2$ and $R_3$, which are substitutes on benzene rings, can be independently selected from the group consisting of hydrogen, halogen, alkyl, alkylene, alkynyl, alkenoxy, alkoxy, thioalkoxy, cyano, amino, carboxylic acid, mono-or di-substituted amino, hydroxy, mercapto, aryloxy, arylthio, carbocyclic aromatic ring group and heterocyclic aromatic ring group.

In another embodiment, there is provided a photoreceptor comprising a substrate, a charge generation layer disposed on the substrate, and a charge transport layer disposed on the charge generation layer, wherein the charge transport layer comprises N,N-di(4-n-butylphenyl),N-(4-methylphenyl) amine in a matrix of N,N'-Bis(3-methylphenyl)-N,N'-diphenyl-benzidine (m-TBD) and a polycarbonate.

Yet another embodiment, there is provided a method for forming an anti-curl back coating-free photoreceptor, comprising providing a substrate, disposing a charge generation layer on the substrate, and disposing a charge transport layer on the charge generation layer, wherein the charge transport layer is further formed by dispersing a liquid plasticizer in a matrix of a hole transport molecule and a polymeric binder. The liquid plasticizer could be synthesized by any suitable organic synthesis methods including Ullmann condensation reaction.

BRIEF DESCRIPTION OF THE DRAWINGS

For a better understanding, reference may be made to the accompanying figures.

DETAILED DESCRIPTION

Figure 1:
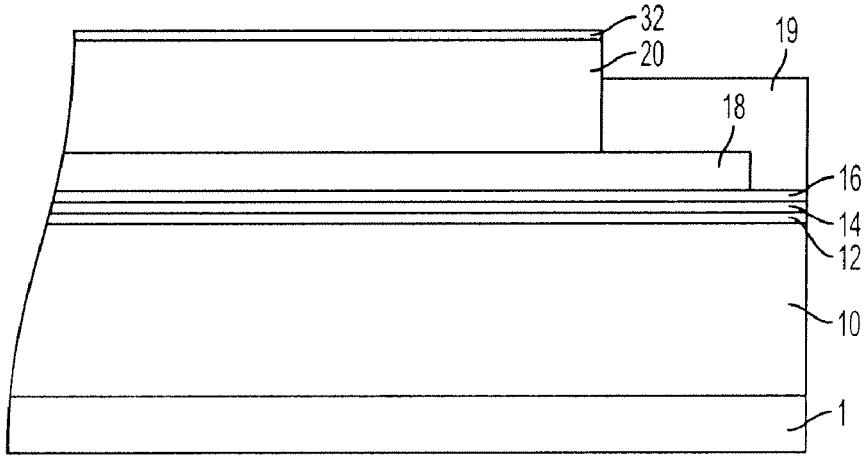
FIG. 1 is a cross-sectional view of a conventional imaging member in a belt configuration.

In the following description, reference is made to the accompanying drawings, which form a part hereof and which illustrate several embodiments. It is understood that other embodiments may be used and structural and operational changes may be made without departure from the scope of the present disclosure.

The presently disclosed embodiments are directed generally to an improved flexible electrophotographic imaging member which does not require the inclusion of an anticurl back coating to prevent curling. In embodiments, the imaging member has a charge transport layer that comprises a class of liquid plasticizers which also have charge transporting capability.

Recent research has demonstrated that the incorporation of certain plasticizers in the CTL enhances the overall photoreceptor belt life while allowing the belt to be anticurl back coating-free (e.g., a photoreceptor without an anticurl back coating layer) without curling. Making imaging members without anticurl back coating layers helps reduce manufacturing time and costs. However, it has been seen that some plasticizers, such as diethyl phthalate (DEP), have drawbacks like long term electrical discharge residual voltage cycle up.

In a plasticizer screening test, DEP has the best performance in the context of electrical properties and mechanical properties. However, charge transport layers with DEP exhibited cycle-up problems. After numerous optimizations, a charge transport layer comprising 9 present DEP provided the best overall performance. With less DEP, the photoreceptor film would have severe curl. With higher DEP content, the photoreceptor would have worse electrical performance such as cycle-up issue, which is related to ghosting. Because DEP lacks photo-active functions, DEP acts more like a binder and has limited compatibility with the N,N'-Bis(3-methylphenyl)-N,N'-diphenyl-benzidine (m-TBD) and polycarbonate present in the charge transport layer.

With the addition of the present plasticizers into the charge transport layer in organic photoreceptors, the application life of the device can be improved from 400,000 prints to 2 million prints in flexible belt or web photoreceptors, including active matrix photoconductor (AMAT) belt photoreceptors. The plasticizer used in the present embodiments keeps the photoreceptor film flat and prevents the crystallization and/or cracking of charge transport molecules. Additionally, the present plasticizers are compatible with the m-TBD/polycarbonate system. As explained previously, although there are various plasticizers for polycarbonate resin, only few of them can be used for the m-TBD/polycarbonate system without any problems.

The present embodiments employ a plasticizer that avoids such drawbacks and to improve the performance of an anticurl back coating-free photoreceptor belt, particularly life extension. In the present embodiments, a hole transporting function is introduced into the plasticizer. Imaging members comprising the synthesized plasticizer in the charge transport layer exhibited good results—little curl, suppressed abrasion/wear failure, satisfactory electricals, no cycle up and satisfactory deletions. In specific embodiments, the charge transport layer comprises a plasticizer selected from the group of compounds having the following chemical structure:

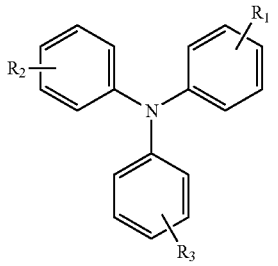

wherein $R_1$, $R_2$ and $R_3$, which are substitutes on benzene rings, can be independently selected from the group consisting of hydrogen, halogen, alkyl, alkylene, alkynyl, alkenoxy, alkoxy, thioalkoxy, cyano, amino, carboxylic acid, mono-or di-substituted amino, hydroxy, mercapto, aryloxy, arylthio, carbocyclic aromatic ring group and heterocyclic aromatic ring group. One example of these compounds is N,N-di (4-n-butylphenyl),N-(4-methylphenyl)amine (BTA). Since the compounds should have functions both as plasticizer and as charge transport capability, the plasticizer should have melting point less than 100° C. under normal pressure. There is no low limit for the melting point of the compound. It would be preferred that the compounds have melting point less than 50° C.

The exemplary embodiments of this disclosure are described below with reference to the drawings. The specific terms are used in the following description for clarity, selected for illustration in the drawings and not to define or limit the scope of the disclosure. The same reference numerals are used to identify the same structure in different figures unless specified otherwise. The structures in the figures are not drawn according to their relative proportions and the drawings should not be interpreted as limiting the disclosure in size, relative size, or location. In addition, though the discussion will address negatively charged systems, the imaging members of the present disclosure may also be used in positively charged systems.

FIG. 1 shows an imaging member having a belt configuration according to the embodiments. As shown, the belt configuration is provided with an anti-curl back coating 1, a supporting substrate 10, an electrically conductive ground plane 12, an undercoat layer 14, an adhesive layer 16, a charge generation layer 18, and a charge transport layer 20. An optional overcoat layer 32 and ground strip 19 may also be included. The charge generation layer 18 and the charge transport layer 20 forms an imaging layer described here as two separate layers. In an alternative to what is shown in the figure, the charge generation layer may also be disposed on top of the charge transport layer. It will be appreciated that the functional components of these layers may alternatively be combined into a single layer. An exemplary photoreceptor having a belt configuration is disclosed in U.S. Pat. No. 5,069,993, which is hereby incorporated by reference.

Figure 2:
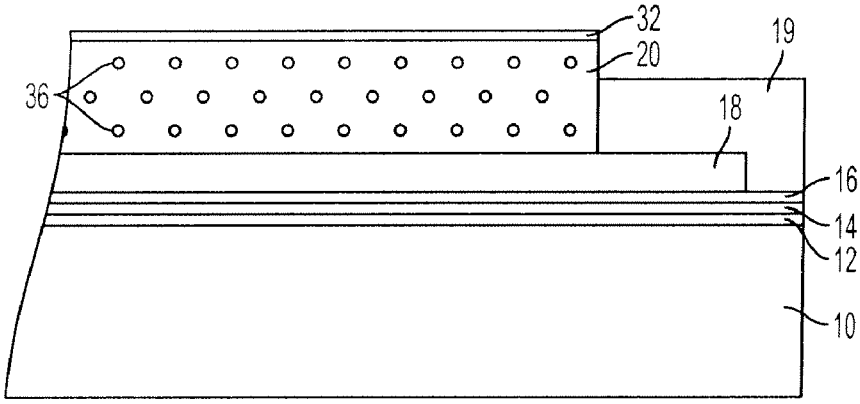
FIG. 2 is a cross-sectional view of an imaging member in a belt configuration according to the present embodiments.

FIG. 2 shows a flexible imaging member according to the present embodiments. As shown, the imaging member comprises a supporting substrate 10, an electrically conductive ground plane 12, an undercoat layer 14, an adhesive layer 16, a charge generation layer 18, and a charge transport layer 20. An optional overcoat layer 32 and ground strip 19 may also be included. The imaging member does not require an anti-curl back coating to counteract curl. Instead, the charge transport layer 20 comprises a specific class of liquid plasticizer 36 which allows the imaging member to remain curl-free without an anti-curl back coating.

As discussed above, an electrophotographic imaging member generally comprises at least a substrate layer, an imaging layer disposed on the substrate and an optional overcoat layer disposed on the imaging layer. In further embodiments, the imaging layer comprises a charge generation layer disposed on the substrate and the charge transport layer disposed on the charge generation layer. In other embodiments, an undercoat layer may be included and is generally located between the substrate and the imaging layer, although additional layers may be present and located between these layers. In the present embodiments, the imaging member does not need to incorporate an anticurl back coating layer, and thus, is both efficient in manufacturing cost and time.

The imaging member can be employed in the imaging process of electrophotography, where the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. The radiation selectively dissipates the charge on the illuminated areas of the photoconductive insulating layer while leaving behind an electrostatic latent image. This electrostatic latent image may then be developed to form a visible image by depositing charged particles of same or opposite polarity on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

The Overcoat Layer

Other layers of the imaging member may include, for example, an optional over coat layer 32. An optional overcoat layer 32, if desired, may be disposed over the charge transport layer 20 to provide imaging member surface protection as well as improve resistance to abrasion. In embodiments, the overcoat layer 32 may have a thickness ranging from about 0.1 micrometer to about 10 micrometers or from about 1 micrometer to about 10 micrometers, or in a specific embodiment, about 3 micrometers. These overcoating layers may include thermoplastic organic polymers or inorganic polymers that are electrically insulating or slightly semi-conductive. For example, overcoat layers may be fabricated from a dispersion including a particulate additive in a resin. Suitable particulate additives for overcoat layers include metal oxides including aluminum oxide, non-metal oxides including silica or low surface energy polytetrafluoroethylene (PTFE), and combinations thereof. Suitable resins include those described above as suitable for photogenerating layers and/or charge transport layers, for example, polyvinyl acetates, polyvinylbutyrals, polyvinylchlorides, vinylchloride and vinyl acetate copolymers, carboxyl-modified vinyl chloride/vinyl acetate copolymers, hydroxyl-modified vinyl chloride/vinyl acetate copolymers, carboxyl-and hydroxyl-modified vinyl chloride/vinyl acetate copolymers, polyvinyl alcohols, polycarbonates, polyesters, polyurethanes, polystyrenes, polybutadienes, polysulfones, polyarylethers, polyarylsulfones, polyethersulfones, polyethylenes, polypropylenes, polymethylpentenes, polyphenylene sulfides, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly-N-vinylpyrrolidinones, acrylate copolymers, alkyd resins, cellulosic film formers, poly (amideimide), styrene-butadiene copolymers, vinylidenechloride-vinylchloride copolymers, vinylacetate-vinylidenechloride copolymers, styrene-alkyd resins, polyvinylcarbazoles, and combinations thereof. Overcoating layers may be continuous and have a thickness of at least about 0.5 micrometer, or no more than 10 micrometers, and in further embodiments have a thickness of at least about 2 micrometers, or no more than 6 micrometers.

In specific embodiments, the overcoat layer is imprinted on its surface with a nano-to micron-scale pattern. The imprinted surface offers numerous unexpected benefits such as, for example, lower friction with the cleaning blade, improved print quality and smoother interaction to minimize blade damage, and consequently longer service life.

The Substrate

The photoreceptor support substrate 10 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed, such as for example, metal or metal alloy. Electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, niobium, stainless steel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and/or oxides.

The substrate 10 can also be formulated entirely of an electrically conductive material, or it can be an insulating material including inorganic or organic polymeric materials, such as MYLAR, a commercially available biaxially oriented polyethylene terephthalate from DuPont, or polyethylene naphthalate available as KALEDEX 2000, with a ground plane layer 12 comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations.

The substrate 10 may have a number of many different configurations, such as for example, a plate, a cylinder, a drum, a scroll, an endless flexible belt, and the like. In the case of the substrate being in the form of a belt, as shown in FIG. 1 and FIG. 2, the belt can be seamed or seamless.

The thickness of the substrate 10 depends on numerous factors, including flexibility, mechanical performance, and economic considerations. The thickness of the support substrate 10 of the present embodiments may be at least about 500 micrometers, or no more than about 3,000 micrometers, or be at least about 750 micrometers, or no more than about 2500 micrometers.

An exemplary substrate support 10 is not soluble in any of the solvents used in each coating layer solution, is optically transparent or semi-transparent, and is thermally stable up to a high temperature of about 150° C. A substrate support 10 used for imaging member fabrication may have a thermal contraction coefficient ranging from about $1\times10^{-5}$ per ° C. to about $3\times10^{-5}$ per ° C. and a Young's Modulus of between about $5\times10^{-5}$ psi ($3.5\times10^{-4}$ Kg/cm$^2$) and about $7\times10^{-5}$ psi ($4.9\times10^{-4}$ Kg/cm$^2$).

The Ground Plane

The electrically conductive ground plane 12 may be an electrically conductive metal layer which may be formed, for example, on the substrate 10 by any suitable coating technique, such as a vacuum depositing technique. Metals include aluminum, zirconium, niobium, tantalum, vanadium, hafnium, titanium, nickel, stainless steel, chromium, tungsten, molybdenum, and other conductive substances, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer may be at least about 20 Angstroms, or no more than about 750 Angstroms, or at least about 50 Angstroms, or no more than about 200 Angstroms for an optimum combination of electrical conductivity, flexibility and light transmission.

Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as transparent layer for light having a wavelength between about 4000 Angstroms and about 9000 Angstroms or a conductive carbon black dispersed in a polymeric binder as an opaque conductive layer.

The Hole Blocking Layer

After deposition of the electrically conductive ground plane layer, the hole blocking layer 14 may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutryral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino) titanate, isopropyl trianthranil titanate, isopropyl tri(N,N-dimethyl-ethylamino) titanate, titanium-4-amino benzene sulfonate oxyacetate, titanium 4 -aminobenzoate isostearate oxyacetate, $[H_2N(CH_2)_4]CH_3\ Si(OCH_3)_2$, (gamma-aminobutyl) methyl diethoxysilane, and $[H_2N(CH_2)_3]CH_3\ Si(OCH_3)_2$ (gamma-aminopropyl) methyl diethoxysilane, as disclosed in U.S. Pat. Nos. 4,338,387, 4,286,033 and 4,291,110.

General embodiments of the undercoat layer may comprise a metal oxide and a resin binder. The metal oxides that can be used with the embodiments herein include, but are not limited to, titanium oxide, zinc oxide, tin oxide, aluminum oxide, silicon oxide, zirconium oxide, indium oxide, molybdenum oxide, and mixtures thereof. Undercoat layer binder materials may include, for example, polyesters, MOR-ESTER 49,000 from Morton International Inc., VITEL PE-100, VITEL PE-200, VITEL PE-200D, and VITEL PE-222 from Goodyear Tire and Rubber Co., polyarylates such as ARDEL from AMOCO Production Products, polysulfone from AMOCO Production Products, polyurethanes, and the like.

The hole blocking layer should be continuous and have a thickness of less than about 0.5 micrometer because greater thicknesses may lead to undesirably high residual voltage. A hole blocking layer of between about 0.005 micrometer and about 0.3 micrometer is used because charge neutralization after the exposure step is facilitated and optimum electrical performance is achieved. A thickness of between about 0.03 micrometer and about 0.06 micrometer is used for hole blocking layers for optimum electrical behavior. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is applied in the form of a dilute solution, with the solvent being removed after deposition of the coating by conventional techniques such as by vacuum, heating and the like. Generally, a weight ratio of hole blocking layer material and solvent of between about 0.05:100 to about 0.5:100 is satisfactory for spray coating.

The Charge Generation Layer

The charge generation layer 18 may thereafter be applied to the undercoat layer 14. Any suitable charge generation binder including a charge generating/photoconductive material, which may be in the form of particles and dispersed in a film forming binder, such as an inactive resin, may be utilized. Examples of charge generating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, enzimidazole perylene, and the like, and mixtures thereof, dispersed in a film forming polymeric binder. Selenium, selenium alloy, benzimidazole perylene, and the like and mixtures thereof may be formed as a continuous, homogeneous charge generation layer. Benzimidazole perylene compositions are well known and described, for example, in U.S. Pat. No. 4,587,189, the entire disclosure thereof being incorporated herein by reference. Multi-charge generation layer compositions may be used where a photoconductive layer enhances or reduces the properties of the charge generation layer. Other suitable charge generating materials known in the art may also be utilized, if desired. The charge generating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

Any suitable inactive resin materials may be employed as a binder in the charge generation layer 18, including those described, for example, in U.S. Pat. No. 3,121,006, the entire disclosure thereof being incorporated herein by reference. Organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like. Another film-forming polymer binder is PCZ-400 (poly (4,4'-dihydroxy-diphenyl-1-1-cyclohexane) which has a viscosity-molecular weight of 40,000 and is available from Mitsubishi Gas Chemical Corporation (Tokyo, Japan).

The charge generating material can be present in the resinous binder composition in various amounts. Generally, at least about 5 percent by volume, or no more than about 90 percent by volume of the charge generating material is dispersed in at least about 95 percent by volume, or no more than about 10 percent by volume of the resinous binder, and more specifically at least about 20 percent, or no more than about 60 percent by volume of the charge generating material is dispersed in at least about 80 percent by volume, or no more than about 40 percent by volume of the resinous binder composition.

In specific embodiments, the charge generation layer 18 may have a thickness of at least about 0.1 μm, or no more than about 2 μm, or of at least about 0.2 μm, or no more than about 1 μm. These embodiments may be comprised of chlorogallium phthalocyanine or hydroxygallium phthalocyanine or mixtures thereof. The charge generation layer 18 containing the charge generating material and the resinous binder material generally ranges in thickness of at least about 0.1 μm, or no more than about 5 μm, for example, from about 0.2 μm to about 3 μm when dry. The charge generation layer thickness is generally related to binder content. Higher binder content compositions generally employ thicker layers for charge generation.

The Charge Transport Layer

Generally, the charge transport layer comprises a single layer of the same composition. As such, the charge transport layer will be discussed specifically in terms of a single layer 20, but the details will be also applicable to an embodiment having dual charge transport layers. The charge transport layer 20 is thereafter applied over the charge generation layer 18 and may include any suitable transparent organic polymer or non-polymeric material capable of supporting the injection of photogenerated holes or electrons from the charge generation layer 18 and capable of allowing the transport of these holes/electrons through the charge transport layer to selectively discharge the surface charge on the imaging member surface. In one embodiment, the charge transport layer 20 not only serves to transport holes, but also protects the charge generation layer 18 from abrasion or chemical attack and may therefore extend the service life of the imaging member. The charge transport layer 20 can be a substantially non-photoconductive material, but one which supports the injection of photogenerated holes from the charge generation layer 18.

Organic photoreceptors are generally fabricated through a layer by layer coating process. The charge transport or hole transport layer, generally the top layer of photoreceptor devices, is coated from a solution of hole transport material and polymeric binders in organic solvents. After drying, a solid solution or transparent thin film of hole transport material in polymer resin is formed which becomes the charge transport layer. The charge or hole transport materials are small organic molecules, which are crystalline solid at room temperature. The polymer binder must be amorphous or have low crystallization degree in order to keep the hole transport layer transparent.

There are two common problems in current photoreceptor device. First, curling may occur during the photoreceptor formation process. When photo-active layers are coated on flexible substrate, the film tends to have curl during drying due to the solvent evaporation. Film curl has detrimental impact on photoreceptor application. Second, cracking or crystallization may occur during photoreceptor use. When a photoreceptor device is under stress or upon heating, small molecular hole transport materials can be easily crystallized, which causes non-transparency, and subsequently cracking.

It has been discovered that, in an anti-curl back coating-free photoreceptor design, photoreceptor device life can be improved by 4 to 5 times when about 10 percent of a plasticizer is added into charge transport layer. Currently used plasticizers, such as diethyl phthalate and bisphenol A diallyl carbonate), however, have essentially no photo-electronic functions. In addition, the conventional hole transport molecular m-TBD also has very limited solubility in these plasticizers. Thus, with the addition of such plasticizers, the photoreceptor device may experience a discharge residual cycle-up issue.

As described above, the present embodiments overcome the problems in the art by using a specific class of liquid plasticizers. The specific plasticizer has hole transport capability and thus avoids the problems with the currently used plasticizers. Imaging members comprising the plasticizer in the charge transport layer exhibited good results—little curl, suppressed abrasion/wear failure, satisfactory electricals, no cycle up and satisfactory deletions. In specific embodiments, the charge transport layer comprises a plasticizer selected from the group of compounds having the following chemical structure:

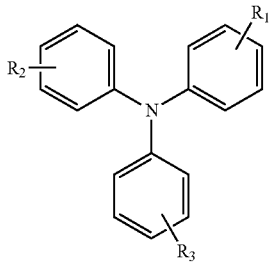

wherein $R_1$, $R_2$ and $R_3$, which are substitutes on benzene rings, can be independently selected from the group consisting of hydrogen, halogen, alkyl, alkylene, alkynyl, alkenoxy, alkoxy, thioalkoxy, cyano, amino, carboxylic acid, mono-or di-substituted amino, hydroxy, mercapto, aryloxy, arylthio, carbocyclic aromatic ring group and heterocyclic aromatic ring group. One example of these compounds is N,N-di (4-n-butylphenyl), N-(4-methylphenyl)amine (BTA). Since the compounds should have functions both as plasticizer and charge transport capability, the plasticizer should have melting point less than 100° C. under normal pressure. There is no low limit for the melting point of the compound. It would be preferred that the compounds have melting point less than 50° C.

In embodiments, the plasticizer 36 is present in the charge transport layer in an amount of from about 0.1 to about 50, or from about 0.5 to about 30, or from about 1 to about 20 percent by weight of the total weight of the charge transport layer 20. The plasticizers of the present embodiments should be liquid at ambient condition or have a melting point close to room temperature.

In embodiments, the hole transport molecule is present in the charge transport layer in an amount of from about 5 percent to about 95 percent be weight of the total weight of the charge transport layer. In embodiments, the polymeric binder is present in the charge transport layer in an amount of from about 5 percent to about 95 percent by weight of the total weight of the charge transport layer.

In a specific embodiment, the liquid plasticizer is N,N-di (4-n-butylphenyl), N-(4-methylphenyl) amine (BTA). BTA is liquid at room temperature. In the present embodiments, it was discovered that use of nano or submicro-sized catalysts can be used to improve the synthesis yield. For example, in embodiments, the BTA was synthesized by an Ullmann condensation reaction with nano-sized copper as the catalyst. With nano-sized catalysts, the yield of this reaction was about 70 percent, compared to a yield of about 50 to 60 percent by traditional Ullmann condensation reaction. The purification of this material was much more simple than the procedure used for m-TBD. Moreover, when BTA was used to partially replace m-TBD in the charge transport layer for a photoreceptor, the device had excellent anti-deletion capability and very good electrical property. In one experimental device, the photoreceptor film with 15 percent of BTA in charge transport layer was completely flat after drying. Thus, the present embodiments provide a novel approach for robust photoreceptor design.

The layer 20 is normally transparent in a wavelength region in which the electrophotographic imaging member is to be used when exposure is affected there to ensure that most of the incident radiation is utilized by the underlying charge generation layer 18. The charge transport layer should exhibit excellent optical transparency with negligible light absorption and no charge generation when exposed to a wavelength of light useful in xerography, e.g., 400 to 900 nanometers. In the case when the photoreceptor is prepared with the use of a transparent substrate 10 and also a transparent or partially transparent conductive layer 12, image wise exposure or erase may be accomplished through the substrate 10 with all light passing through the back side of the substrate. In this case, the materials of the layer 20 need not transmit light in the wavelength region of use if the charge generation layer 18 is sandwiched between the substrate and the charge transport layer 20. The charge transport layer 20 in conjunction with the charge generation layer 18 is an insulator to the extent that an electrostatic charge placed on the charge transport layer is not conducted in the absence of illumination. The charge transport layer 20 should trap minimal charges as the charge passes through it during the discharging process.

The charge transport layer 20 may include any suitable charge transport component or activating compound useful as an additive dissolved or molecularly dispersed in an electrically inactive polymeric material, such as a polycarbonate binder, to form a solid solution and thereby making this material electrically active. "Dissolved" refers, for example, to forming a solution in which the small molecule is dissolved in the polymer to form a homogeneous phase; and molecularly dispersed in embodiments refers, for example, to charge transporting molecules dispersed in the polymer, the small molecules being dispersed in the polymer on a molecular scale. The charge transport component may be added to a film forming polymeric material which is otherwise incapable of supporting the injection of photogenerated holes from the charge generation material and incapable of allowing the transport of these holes through. This addition converts the electrically inactive polymeric material to a material capable of supporting the injection of photogenerated holes from the charge generation layer 18 and capable of allowing the transport of these holes through the charge transport layer 20 in order to discharge the surface charge on the charge transport layer. The high mobility charge transport component may comprise small molecules of an organic compound which cooperate to transport charge between molecules and ultimately to the surface of the charge transport layer. For example, but not limited to, N,N'-diphenyl-N,N-bis(3-methyl phenyl)-1,1'-biphenyl-4,4'-diamine (TPD), other arylamines like triphenyl amine, N,N,N',N'-tetra-p-tolyl-1,1'-biphenyl-4, 4'-diamine (TM-TPD), and the like.

A number of charge transport compounds can be included in the charge transport layer, which layer generally is of a thickness of from about 5 to about 75 micrometers, and more specifically, of a thickness of from about 15 to about 40 micrometers. Examples of charge transport components are aryl amines of the following formulas/structures:

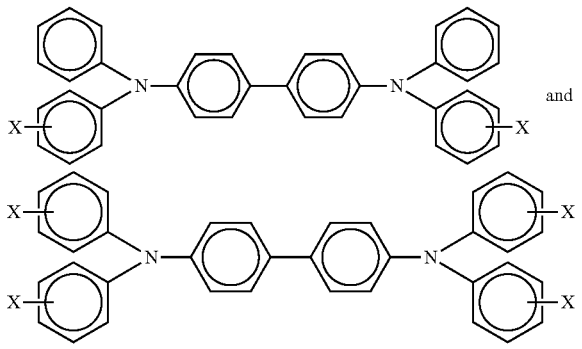

wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

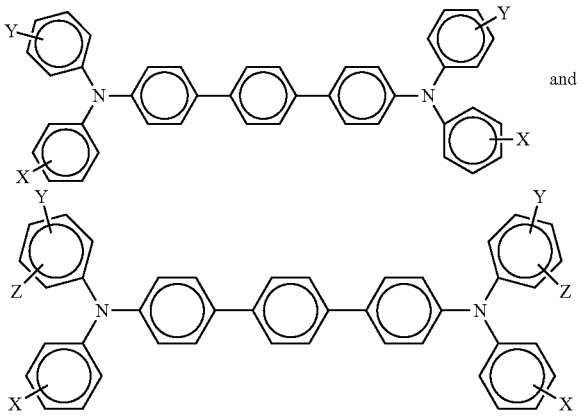

wherein X, Y and Z are independently alkyl, alkoxy, aryl, a halogen, or mixtures thereof, and wherein at least one of Y and Z are present.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines that can be selected for the charge transport layer include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules may be selected in embodiments, reference for example, U.S. Pat. Nos. 4,921,773 and 4,464,450, the disclosures of which are totally incorporated herein by reference.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), and epoxies, and random or alternating copolymers thereof. In embodiments, the charge transport layer, such as a hole transport layer, may have a thickness of at least about 10 μm, or no more than about 40 μm.

Examples of components or materials optionally incorporated into the charge transport layers or at least one charge transport layer to, for example, enable improved lateral charge migration (LCM) resistance include hindered phenolic antioxidants such as tetrakis methylene(3,5-di-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NR, BP-76, BP-101, GA-80, GM and GS (available from Sumitomo Chemical Co., Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SANKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER® TPS (available from Sumitomo Chemical Co., Ltd.); thioether antioxidants such as SUMILIZER® TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2 -methylphenyl)phenylmethane (BDETPM), bis-[2-methyl-4-(N-2-hydroxyethyl-N-ethylaminophenyl) ]-phenylmethane (DHTPM), and the like. The weight percent of the antioxidant in at least one of the charge transport layer is from about 0 to about 20, from about 1 to about 10, or from about 3 to about 8 weight percent.

The charge transport layer should be an insulator to the extent that the electrostatic charge placed on the hole transport layer is not conducted in the absence of illumination at a rate sufficient to prevent formation and retention of an electrostatic latent image thereon. The charge transport layer is substantially nonabsorbing to visible light or radiation in the region of intended use, but is electrically "active" in that it allows the injection of photogenerated holes from the photoconductive layer, that is the charge generation layer, and allows these holes to be transported through itself to selectively discharge a surface charge on the surface of the active layer.

In addition, in the present embodiments using a belt configuration, the charge transport layer may consist of a single pass charge transport layer or a dual pass charge transport layer (or dual layer charge transport layer) with the same or different transport molecule ratios. In these embodiments, the dual layer charge transport layer has a total thickness of from about 10 μm to about 40 μm. In other embodiments, each layer of the dual layer charge transport layer may have an individual thickness of from 2 μm to about 20 μm. Moreover, the charge transport layer may be configured such that it is used as a top layer of the photoreceptor to inhibit crystallization at the interface of the charge transport layer and the overcoat layer. In another embodiment, the charge transport layer may be configured such that it is used as a first pass charge transport layer to inhibit microcrystallization occurring at the interface between the first pass and second pass layers.

Any suitable and conventional technique may be utilized to form and thereafter apply the charge transport layer mixture to the supporting substrate layer. The charge transport layer may be formed in a single coating step or in multiple coating steps. Dip coating, ring coating, spray, gravure or any other coating methods may be used.

Drying of the deposited coating may be effected by any suitable conventional technique such as oven drying, infra red radiation drying, air drying and the like. The thickness of the charge transport layer after drying is from about 10 μm to about 40 μm or from about 12 μm to about 36 μm for optimum photoelectrical and mechanical results. In another embodiment the thickness is from about 14 μm to about 36 μm.

The Adhesive Layer

An optional separate adhesive interface layer may be provided in certain configurations, such as for example, in flexible web configurations. In the embodiment illustrated in FIG. and FIG. 2, the interface layer would be situated between the blocking layer 14 and the charge generation layer 18. The interface layer may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-100, VITEL PE-200, VITEL PE-200D, and VITEL PE-222, all from Bostik, 49,000 polyester from Rohm Hass, polyvinyl butyral, and the like. The adhesive interface layer may be applied directly to the hole blocking layer 14. Thus, the adhesive interface layer in embodiments is in direct contiguous contact with both the underlying hole blocking layer 14 and the overlying charge generator layer 18 to enhance adhesion bonding to provide linkage. In yet other embodiments, the adhesive interface layer is entirely omitted.

Any suitable solvent or solvent mixtures may be employed to form a coating solution of the polyester for the adhesive interface layer. Solvents may include tetrahydrofuran, toluene, monochlorobenzene, methylene chloride, cyclohexanone, and the like, and mixtures thereof. Any other suitable and conventional technique may be used to mix and thereafter apply the adhesive layer coating mixture to the hole blocking layer. Application techniques may include spraying, dip coating, roll coating, wire wound rod coating, and the like. Drying of the deposited wet coating may be effected by any suitable conventional process, such as oven drying, infra red radiation drying, air drying, and the like.

The adhesive interface layer may have a thickness of at least about 0.01 micrometers, or no more than about 900 micrometers after drying. In embodiments, the dried thickness is from about 0.03 micrometers to about 1 micrometer.

The Ground Strip

The ground strip may comprise a film forming polymer binder and electrically conductive particles. Any suitable electrically conductive particles may be used in the electrically conductive ground strip layer 19. The ground strip 19 may comprise materials which include those enumerated in U.S. Pat. No. 4,664,995. Electrically conductive particles include carbon black, graphite, copper, silver, gold, nickel, tantalum, chromium, zirconium, vanadium, niobium, indium tin oxide and the like. The electrically conductive particles may have any suitable shape. Shapes may include irregular, granular, spherical, elliptical, cubic, flake, filament, and the like. The electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The ground strip layer may have a thickness of at least about 7 micrometers, or no more than about 42 micrometers, or of at least about 14 micrometers, or no more than about 27 micrometers.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The example set forth herein below and is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

Example 1

Synthesis of BTA

In a round-bottom 500-ml three necked flask equipped with mechanical stirrer, inert gas inlet and thermometer, N,N-di(4-n-butylphenyl)amine 28.1 g, 4 -iodotoluene 21.8 g, potassium carbonate 34.5 g, copper powder with mean volume particle size about 350 nm 2.92 g and solvent N-methylpyrrolidone NMP 20 ml were added. Under nitrogen gas flowing and mechanical stirring, the mixture was heat to 200° C. for 18 hours. Then, the flask was cooled down to about 120° C., and 300 ml of toluene was added. The mixture was heated to refluxing for 1 hour, and the hot slurry was filtered. The filtrate was washed by 3×150 ml of DI water. After washing, Filtrol 120 g was added into the toluene solution. This toluene solution with Filtrol was heated to refluxing for 2 hours. After cooled down to room temperature, Filtrol was filtered off. Toluene was evaporated off by a rotavapor. A viscous light-brown liquid 26.1 g was collected. This material was ready for photoreceptor application without further purification.

Example 2

Photoreceptor with BTA in the Charge Transport Layer

Coatings solution with the following charge transport layer formulations shown in Table 1 were prepared.

TABLE 1

| Sample | m-TBD (g) | BTA (g) | Polycarbonate (g) | Methylene chloride (g) |
|---|---|---|---|---|
| A | 1.5 | 0 | 1.5 | 17 |
| B | 1.25 | 0.25 | 1.5 | 17 |
| C | 1.0 | 0.5 | 1.5 | 17 |

The solutions were coated on substrates followed by layers up to the charge generation layer by a 4.5-mil Bird bar respectively, and dried at 120° C. for 1 minute. The substrate and other imaging member layers were prepared using conventional techniques as follows.

There was prepared an imaging member with a biaxially oriented polyethylene naphthalate substrate (KALEDEX™ 2000) having a thickness of 3.5 mils, and thereover, a 0.02 micron thick titanium layer was coated on the biaxially oriented polyethylene naphthalate substrate (KALEDEX™ 2000). Subsequently, there was applied thereon, with an extrusion coater, a hole blocking layer solution containing 50 grams of 3 aminopropyl triethoxysilane (γ-APS), 41.2 grams of water, 15 grams of acetic acid, 684.8 grams of denatured alcohol, and 200 grams of heptane. This layer was then dried for about 1 minute at 120° C. in a forced air dryer. The resulting hole blocking layer had a dry thickness of 500 Angstroms. An adhesive layer was then deposited over the hole blocking layer using an extrusion coater, and which adhesive layer contained 0.2 percent by weight based on the total weight of the solution of the copolyester adhesive (ARDEL D100™ available from Toyota Hsutsu Inc.) in a 60:30:10 volume ratio mixture of tetrahydrofuran/monochlorobenzene/methylene chloride. The adhesive layer was then dried for about 1 minute at 120° C. in the forced air dryer of the coater. The resulting adhesive layer had a dry thickness of 200 Angstroms.

A photogenerating layer dispersion was prepared by introducing 0.45 gram of the known polycarbonate IUPILON200™ (PCZ-200) weight average molecular weight of 20,000, available from Mitsubishi Gas Chemical Corporation, and 44.65 grams of tetrahydrofuran (THF) into a 4 ounce glass bottle. To this solution were added 2.4 grams of hydroxygallium phthalocyanine (Type V), and 300 grams of ⅛ inch (3.2 millimeters) diameter stainless steel shot. This mixture was then placed on a ball mill for 3 hours. Subsequently, 2.25 grams of PCZ-200 were dissolved in 46.1 grams of THF, and added to the hydroxygallium phthalocyanine dispersion. This slurry was then placed on a shaker for 10 minutes. The resulting dispersion was, thereafter, applied to the above adhesive interface with an extrusion coater. A strip about 10 millimeters wide along one edge of the substrate web bearing the blocking layer, and the adhesive layer was deliberately left uncoated by any of the photogenerating layer material to facilitate adequate electrical contact by the ground strip layer that was applied later. The photogenerating layer was dried at 120° C. for 1 minute in a forced air oven to form a dry photogenerating layer of hydroxygallium phthalocyanine Type V and PCZ 200 with a weight ratio of about 47/53, and having a thickness of 0.8 micrometer. The resulting imaging member webs were then overcoated with charge transport layers of Table 1.

Results

Electrical scanner (Xerox 4000) data for the samples are summarized in Table 2. Vo is the initial potential after the charging step. The initial slope of the photo-induced discharge curve (PIDC) is termed S and the residual potential after the erase step is termed Vr. The residual cycle-up voltage after 10,000 cycles of charge, expose, and erase steps is also shown.

The photoreceptor film device of Sample A had curl like a roll, Sample B had a curl that was U-shaped, and Sample C was completely flat.

TABLE 2

| Sample | Vo (volt) | S | Vr (volt) | V cycle-up after 10K (volt) |
|---|---|---|---|---|
| A | 800 | 354 | 38.3 | 26.0 |
| B | 799 | 359 | 32.6 | 35.6 |
| C | 799 | 371 | 46.8 | 41.4 |

The electrical performance of photoreceptor devices with the hole transport molecule plasticizer was very good. There was slight Vr cycle-up with the addition of BTA more than 15%, but Vr and V cycle-up were still within the acceptable range to achieve fine image quality.

A lateral charge migration (LCM) test was performed which demonstrated deletion results in imaging members according to the present embodiments as compared to control imaging members.

In summary, the present embodiments provide an improved photoreceptor device which, by incorporating a liquid plasticizer with hole transport capability into the charge transport layer, provides a substantial reduction in both manufacturing time and cost. The anti-curl back coating-free photoreceptor device of the present embodiments does not suffer from curling and still exhibits good electrical properties and performance.

All the patents and applications referred to herein are hereby specifically, and totally incorporated herein by reference in their entirety in the instant specification.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An anti-curl back coating-free photoreceptor comprising:

a substrate;

a charge generation layer disposed on the substrate; and a charge transport layer disposed on the charge generation layer, wherein the charge transport layer comprises a liquid plasticizer in a matrix of a hole transport molecule and polycarbonate and further wherein the liquid plasticizer is N,N-di(4-n-butylphenyl)-N-(4-methylphenyl) amine.

2. The photoreceptor of claim 1, wherein the liquid plasticizer is present in the charge transport layer in an amount of from about 0.1 percent to about 50 percent by weight of the total weight of the charge transport layer.

3. The photoreceptor of claim 2, wherein the liquid plasticizer is present in the charge transport layer in an amount of from about 0.5 percent to about 30 percent by weight of the total weight of the charge transport layer.

4. The photoreceptor of claim 3, wherein the liquid plasticizer is present in the charge transport layer in an amount of from about 1 percent to about 20 percent by weight of the total weight of the charge transport layer.

5. The photoreceptor of claim 1, wherein the liquid plasticizer is liquid at room temperature.

6. The photoreceptor of claim 1, wherein the charge transport layer comprises more than one layer and wherein the liquid plasticizer is present in each of the charge transport layers.

7. The photoreceptor of claim 1, wherein the hole transport molecule is present in the charge transport layer in an amount of from about 5 percent to about 95 percent be weight of the total weight of the charge transport layer.

8. The photoreceptor of claim 1, wherein the polycarbonate is present in the charge transport layer in an amount of from about 5 percent to about 95 percent by weight of the total weight of the charge transport layer.

9. A photoreceptor comprising:

a substrate;

a charge generation layer disposed on the substrate; and a charge transport layer disposed on the charge generation layer, wherein the charge transport layer comprises N,N-di(4-n-butylphenyl),N-(4-methylphenyl)amine in a matrix of N,N'-Bis(3-methylphenyl)-N,N'-diphenyl-benzidine (m-TBD) and a polycarbonate.

10. The photoreceptor of claim 9, wherein the liquid plasticizer is present in the charge transport layer in an amount of from about 0.1 percent to about 50 percent by weight of the total weight of the charge transport layer.

11. The photoreceptor of claim 9, wherein the N,N'-Bis(3-methylphenyl)-N,N'-diphenyl-benzidine (m-TBD) is present in the charge transport layer in an amount of from about 5 percent to about 95 percent be weight of the total weight of the charge transport layer.

12. The photoreceptor of claim 9, wherein the polycarbonate is present in the charge transport layer in an amount of from about 5 percent to about 95 percent by weight of the total weight of the charge transport layer.

13. A method for forming an anti-curl back coating-free photoreceptor, comprising:

providing a substrate;

disposing a charge generation layer on the substrate; and disposing a charge transport layer on the charge generation layer, wherein the charge transport layer is further formed by dispersing a liquid plasticizer in a matrix of a hole transport molecule and a polymeric binder, the liquid plasticizer being synthesized by an organic synthesis reaction, wherein the liquid plasticizer is N,N-di (4-n-butylphenyl)-N-(4-methylphenyl)amine.

14. The method of claim 13, wherein the organic synthesis reaction is an Ullmann condensation reaction.

15. The method of claim 13, wherein nano or submicro-sized catalysts are used to improve synthesis yield.

16. The method of claim 13, wherein the liquid plasticizer is present in the charge transport layer in an amount of from about 0.1 percent to about 50 percent by weight of the total weight of the charge transport layer.

17. The method of claim 13, wherein the hole transport molecule is present in the charge transport layer in an amount of from about 5 percent to about 95 percent be weight of the total weight of the charge transport layer.

18. The method of claim 13, wherein the polymeric binder is present in the charge transport layer in an amount of from about 5 percent to about 95 percent by weight of the total weight of the charge transport layer.

19. The photoreceptor of claim 1, wherein the weight ratio of the hole transport molecule to the liquid plasticizer is from 5:1 to 2:1.

* * * * *